US008770668B2

(12) United States Patent
Hall et al.

(10) Patent No.: US 8,770,668 B2
(45) **Date of Patent: *Jul. 8, 2014**

(54) SYSTEM AND METHOD FOR EXCHANGING A MILLING DRUM ASSEMBLY

(76) Inventors: David R. Hall, Provo, UT (US); Jeff Jepson, Spanish Fork, UT (US); Thomas Morris, Spanish Fork, UT (US); David Wahlquist, Spanish Fork, UT (US); Daniel Balling, Provo, UT (US)

( * ) Notice: Subject to any disclaimer, the term of this patent is extended or adjusted under 35 U.S.C. 154(b) by 641 days.

This patent is subject to a terminal disclaimer.

(21) Appl. No.: 12/957,119

(22) Filed: Nov. 30, 2010

(65) Prior Publication Data

US 2012/0131783 A1 May 31, 2012

(51) Int. Cl.
*E01C 23/12* (2006.01)

(52) U.S. Cl.
USPC ..... 299/39.4; 29/426.1

(58) Field of Classification Search
USPC ..... 29/426.1; 299/39.1–39.9
See application file for complete search history.

(56) References Cited

U.S. PATENT DOCUMENTS

| | | | | |
|---|---|---|---|---|
| 5,722,789 | A * | 3/1998 | Murray et al. | 404/90 |
| 6,193,218 | B1 * | 2/2001 | Philyaw | 254/326 |
| 6,877,818 | B1 * | 4/2005 | Gaertner et al. | 299/39.8 |
| 7,396,085 | B2 * | 7/2008 | Hall et al. | 299/39.1 |
| 8,256,847 | B2 * | 9/2012 | Hall et al. | 299/39.4 |
| 2006/0204331 | A1 * | 9/2006 | Hall et al. | 404/75 |
| 2009/0052987 | A1 * | 2/2009 | Hall et al. | 404/90 |
| 2012/0219394 | A1 * | 8/2012 | Stewart et al. | 414/510 |

* cited by examiner

*Primary Examiner* — Minh Trinh
(74) *Attorney, Agent, or Firm* — Philip W. Townsend, III

(57) ABSTRACT

In one aspect of the invention, a system for exchanging a milling chamber comprises a vehicle comprising a milling chamber supported by the underside of the vehicle. The underside comprises a track that interfaces with a guide of the milling chamber. The track and guide are configured to accommodate lateral movement of the milling chamber with respect to a length of the vehicle.

19 Claims, 16 Drawing Sheets

SYSTEM AND METHOD FOR EXCHANGING A MILLING DRUM ASSEMBLY

BACKGROUND OF THE INVENTION

The present invention relates generally to road milling machines and especially to methods for replacing milling drums on road milling machines. Road milling machines typically comprise a vehicle body, self propelling mechanisms, and a rotary drum with a plurality of picks for degrading road surfaces. The rotary drum may be held within a drum housing that is secured to the underside of the vehicle body.

During milling operations, picks may wear or break requiring maintenance of the drum before a job's completion. Such repairs delay projects and reduce profitability. The prior art has address mechanisms to quickly repair a damaged drum.

U.S. Pat. No. 5,722,789 to Murray, which is herein incorporated by reference for all that it contains, discloses a modification of a cold milling machine used to remove concrete and asphalt from an existing highway including a milling drum segmented into two or more sections with the drive train for the milling drums passing through the core of the milling drum and supported via a journal or bearing to the outside of the machine. The width of the milling drum can be varied by replacing one section of drum with a segmented drum that is either wider or narrower. The sections of the milling drum can be added by bolting segments of the drum onto a driven sleeve which telescopes over the drive shaft of the machine. The segments of the milling drum can be readily removed by loosening a few bolts, and removing the segments without having to slide a milling drum segment off of either end of a drive shaft.

BRIEF SUMMARY OF THE INVENTION

In one aspect of the invention, a system for exchanging a milling chamber comprises a vehicle with a milling chamber supported by the underside of the vehicle. The underside comprises a track that interfaces with a guide of the milling chamber. The track and guide are configured to accommodate lateral movement of the milling chamber with respect to a length of the vehicle.

The vehicle may be a milling machine, truck or other vehicle. The milling chamber may comprise a rotary drum assembly. The track may comprise at least one roller configured to be accompanied by the guide. The roller may be in mechanical communication with a rotor of a motor with a built-in-gearbox. The milling chamber may comprise a moldboard aligned concentrically with the rotary drum assembly. The milling chamber may comprise a water jet manifold, an air manifold, or electronic equipment attached to an end of the moldboard.

The guide may comprise a structure configured to stop a lateral movement of the milling chamber as the milling chamber approaches an end of the guide. The vehicle may comprise a winch assembly configured to pull the milling chamber laterally. A pulley may be configured to guide a cable of the winch assembly when pulling the milling chamber. The underside of the vehicle may be located on a trailer of the vehicle.

The system may comprise a hydraulic ram configured to push the milling chamber. The track and guide may also interface through a rack and pinion arrangement. A second track may be linked to the first track by a cross arm attached to the milling machine. The track may be configured to hang off the guide. The underside may comprise a mechanism configured to distribute a weight of the milling chamber off of the guide.

In another aspect of the invention, a method of replacing a rotary drum assembly on a milling machine comprises the steps of providing a milling machine comprising a rotary drum assembly supported by the underside of the machine, a separate vehicle configured to carry a plurality of rotary drum assemblies, aligning the milling machine with the separate vehicle, and exchanging at least one rotary drum assembly between the milling machine and the separate vehicle with a sliding mechanism.

In another aspect of the invention, a system for exchanging a drum assembly may comprise a vehicle comprising a rotary drum assembly supported by the underside of the vehicle. The underside may comprise a track that interfaces with a guide of the milling chamber. The track and guide may be configured to accommodate lateral movement of the rotary drum assembly with respect to a length of the vehicle.

DETAILED DESCRIPTION OF THE INVENTION AND THE PREFERRED EMBODIMENT

Figure 1:
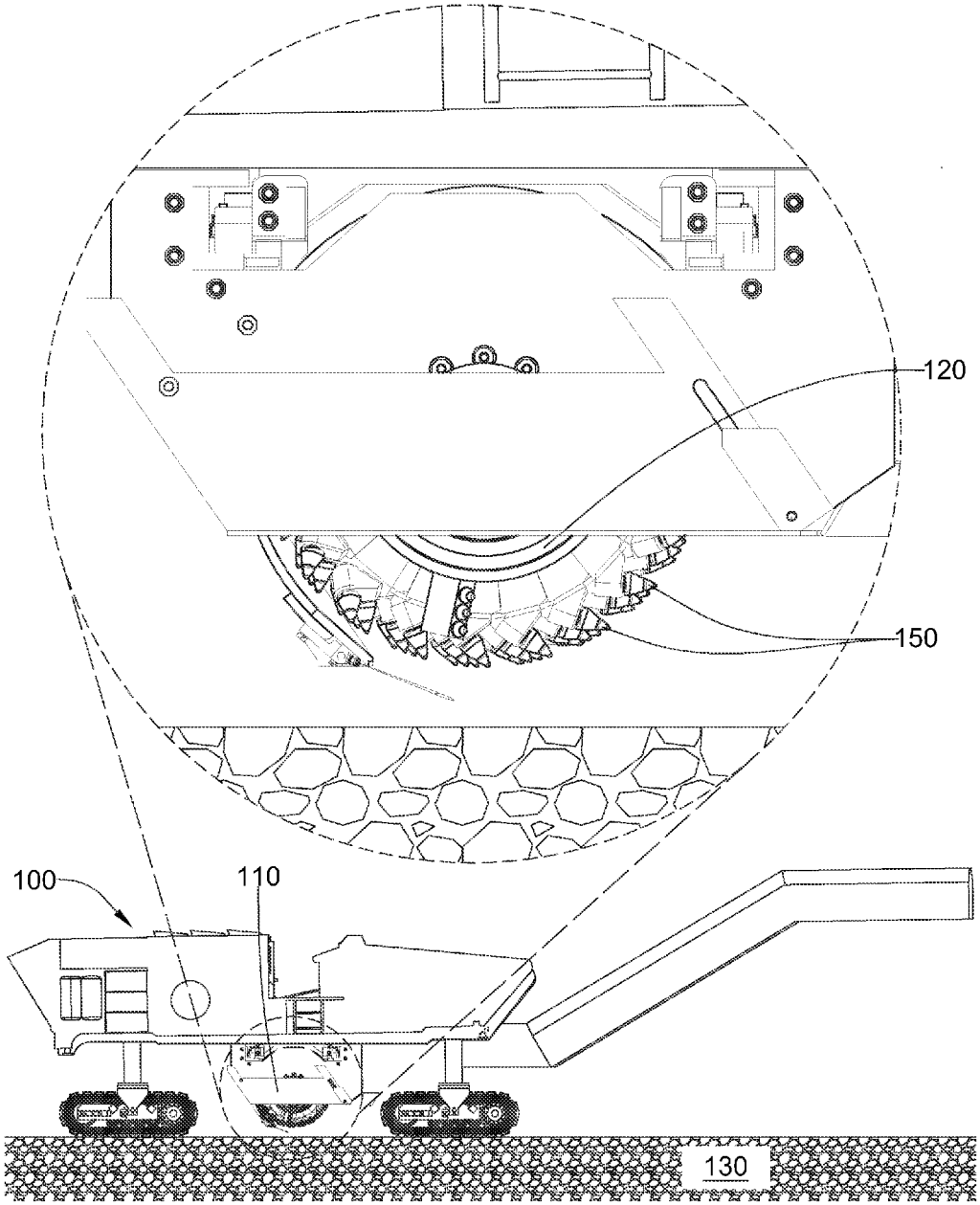
FIG. 1 is an orthogonal diagram of an embodiment of a milling machine.

FIG. 1 is an orthogonal diagram of an embodiment of a milling machine 100 comprising a milling chamber 110. The milling chamber 110 may comprise a rotary drum assembly 120, a moldboard, front plate, and side plates. The milling machine 100 may be an asphalt planar used to degrade man-made formations 130 such as pavement prior to placement of a new layer of pavement. The milling chamber 110 may be attached to the underside of the milling machine 100. The rotary drum assembly 120 may comprise a plurality of cutting elements 150. A holder, such as a block welded or bolted to the rotary drum assembly 120 may hold the cutting elements 150 at an angle offset from a direction of rotation of the drum, such that the cutting elements 150 engage the formation 130 at a preferential angle.

Figure 2:
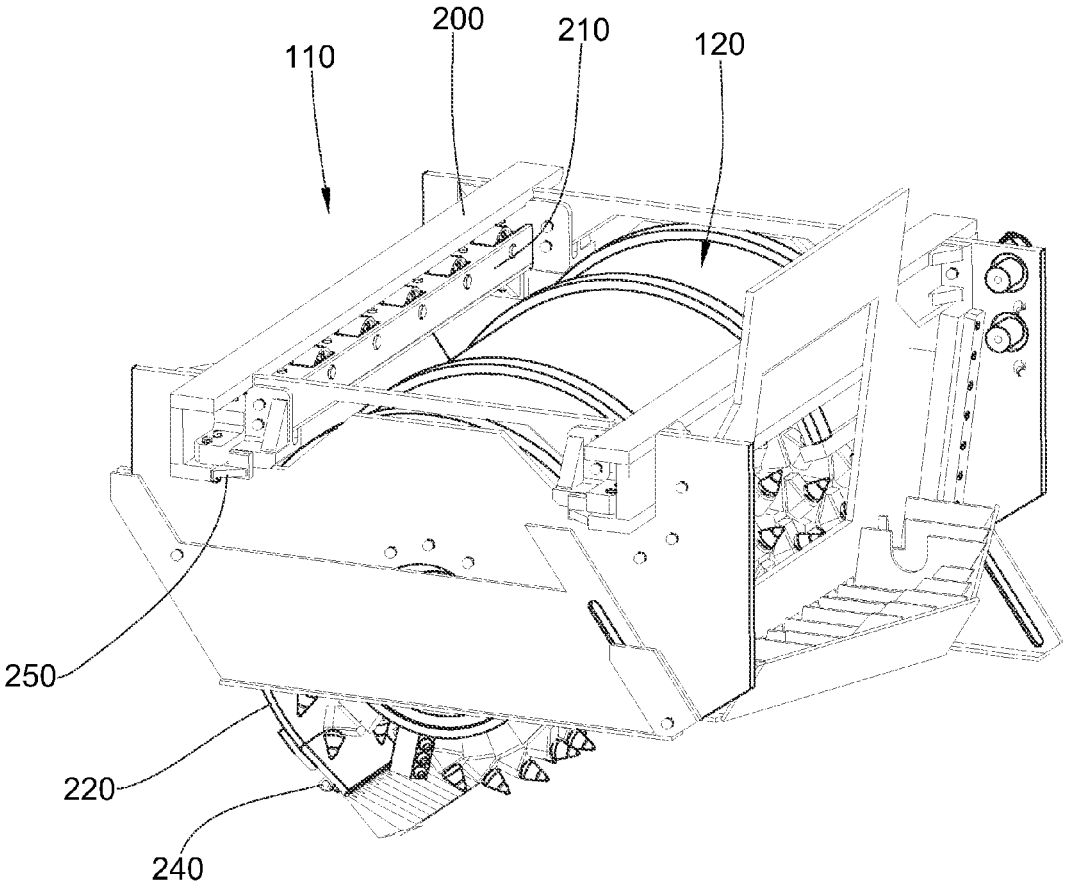
FIG. 2 is a perspective diagram of an embodiment of a milling chamber.

FIG. 2 discloses a milling chamber 110 comprising a rotary drum assembly 120 in mechanical communication with a guide 200. The guide 200 may interface with a track 210 supported by the underside of the milling machine 100. The track 210 and guide 200 may be configured to accommodate lateral movement of the milling chamber 110 with respect to a length of the milling machine 100. The milling chamber 110 may comprise several structures configured to accommodate the lateral movement. The guide 200 may further comprise a structure 250 configured to stop a lateral movement of the milling chamber 110 as the milling chamber 110 approaches an end of the guide 200. Such an arrangement may prevent the milling chamber 110 from sliding past a designated space. The designated space may be the underside of the milling machine 100, truck, trailer, or other vehicle. The track 210 may be configured to hang off the guide 200 while accommodating lateral movement of the milling chamber 110 with respect to the length of the milling machine 100.

The milling chamber 110 may further comprise a mechanism configured to reduce the weight of the milling chamber 110 off of the guide 200 while the rotary drum assembly 120 is in operation. The track 210 may be bolted to a lower surface of the guide 200 while the rotary drum assembly 120 is in operation. The milling chamber 110 may be lifted off of the guide when the track 210 is bolted with the lower surface of the guide 200. Such a mechanism may distribute the weight of the milling chamber 110 and also keep the milling chamber 110 firmly attached to the milling machine 100 during operation. Sensitive components to the system, like ball bearings, may be spared while the milling machine is in operation by lifting at least a portion of the milling machine's weight up.

The milling chamber 110 may further comprise a moldboard 220 and a water jet manifold 240. The water jet manifold 240 may be attached to the bottom of the moldboard 220. In some embodiments, the moldboard 220 and the water jet manifold 240 may be permanently attached to the rotary drum assembly 120. In some embodiments, the moldboard 220 and the water jet manifold 240 may be temporarily attached to the rotary drum assembly 120. The temporarily attached moldboard and the water jet manifold may be disassembled from one milling chamber, and assembled to another milling chamber. Such an embodiment may avoid the necessity of having separate moldboard and water jet manifold for each milling chamber.

Figure 3:
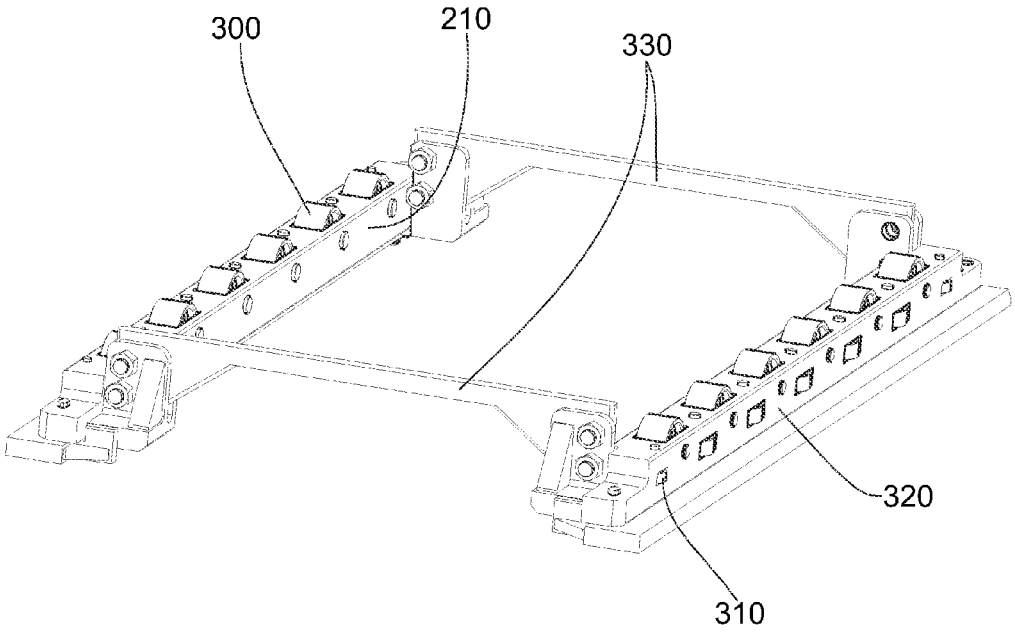
FIG. 3 is a perspective diagram of an embodiment of a track of a milling machine.

Referring to FIG. 3, the track 210 may comprise at least one roller 300 configured to move the milling chamber 110. In some embodiments, the roller 300 may be in mechanical communication with a rotor of a motor with built-in gearbox. Such an embodiment may allow the guide 200 to slide over the roller 300 readily at a uniform speed. The roller 300 may be aligned in vertical and horizontal planes. Such a combination may align the milling chamber 110 along the direction of the lateral movement. The track 210 may further comprise a first roller 310 configured to help with self alignment of the milling chamber 110 as the milling chamber 110 starts to move. The first roller 310 may be smaller in size compared to other rollers 300. The first track 210 and a second track 320 may be linked by a cross arm 330 attached to the milling machine 100. The cross arm 330 may be welded to the underside of the milling machine 100.

In some embodiments, the track 210 is configured to move with the milling chamber, while in other embodiments, the track 210 is configured to be stationary with respect to the underside of vehicle.

Figure 4:
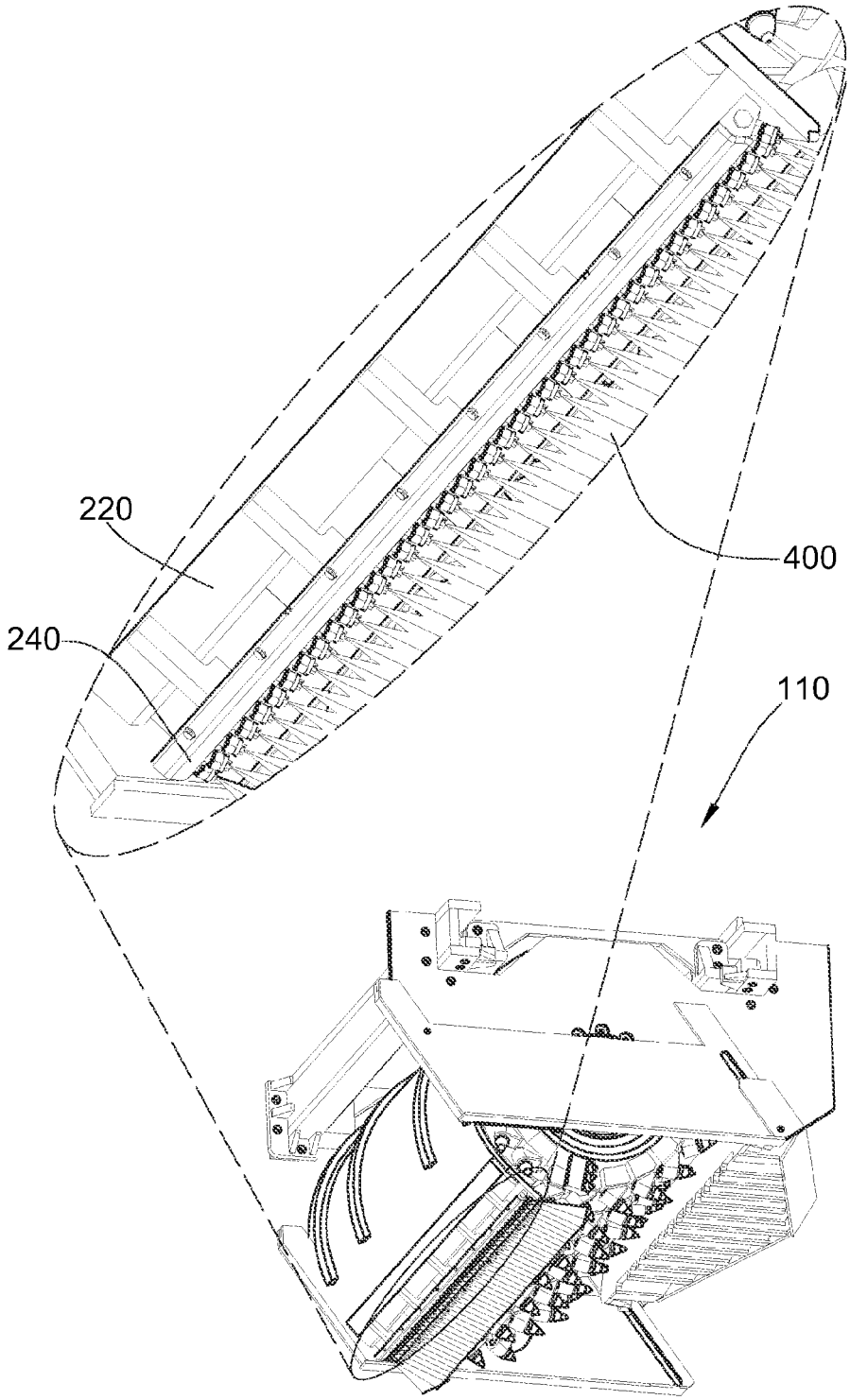
FIG. 4 is a perspective diagram of another embodiment of a milling chamber.

Referring to FIG. 4, the milling chamber 110 may comprise the moldboard 220 aligned concentrically with the rotary drum assembly 120. Such an alignment of the moldboard 220 may allow less mud and debris to pile up at the bottom end of the moldboard 220 while the rotary drum assembly 120 is in operation compared to a straight alignment of the moldboard 220 that provides more space for dirt and mud to pile up. Such an embodiment may also allow water 400 from the water jet manifold 240 attached to the bottom of the moldboard 220 to reach the cutting elements 150 easily by passing through a thin layer of mud and dirt. Thus, the cutting elements 150 may remain clean and undisturbed by dirt and debris while the rotary drum assembly 120 is in operation. In some embodiments, the moldboard 220 may comprise a plurality of segments configured to slide up and down, thereby overlapping itself.

Figure 5:
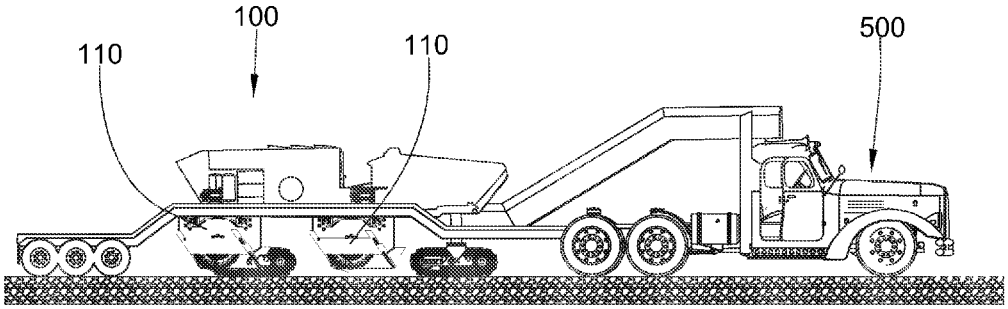
FIG. 5 is an orthogonal diagram of an embodiment of a milling machine and a semi-truck.

FIG. 5 is an orthogonal diagram of an embodiment of the milling machine 100 and a semi-truck 500 aligned to exchange the milling chamber 110. Both the milling machine 100 and the semi-truck 500 may comprise the milling chamber 110. The milling chamber 110 in the milling machine 100 may comprise a rotary drum assembly comprising dull or damaged cutting elements. The semi-truck 500 may comprise a serviced rotary drum assembly. The semi-truck 500 may also comprise an extra track supported by its underside, and configured to support a milling chamber. The milling machine 100 and the semi-truck 500 may align together such that the extra track in the semi-truck 500 is able to receive a milling chamber from the milling machine 100. The milling chamber 110 may then be exchanged between the milling machine 100 and the semi-truck 500 by the lateral movement produced by the track 210 and the guide 200. The same lateral movement may be used in opposite direction to exchange a milling chamber 110 from the semi-truck 500 to the milling machine 100.

Figure 6:
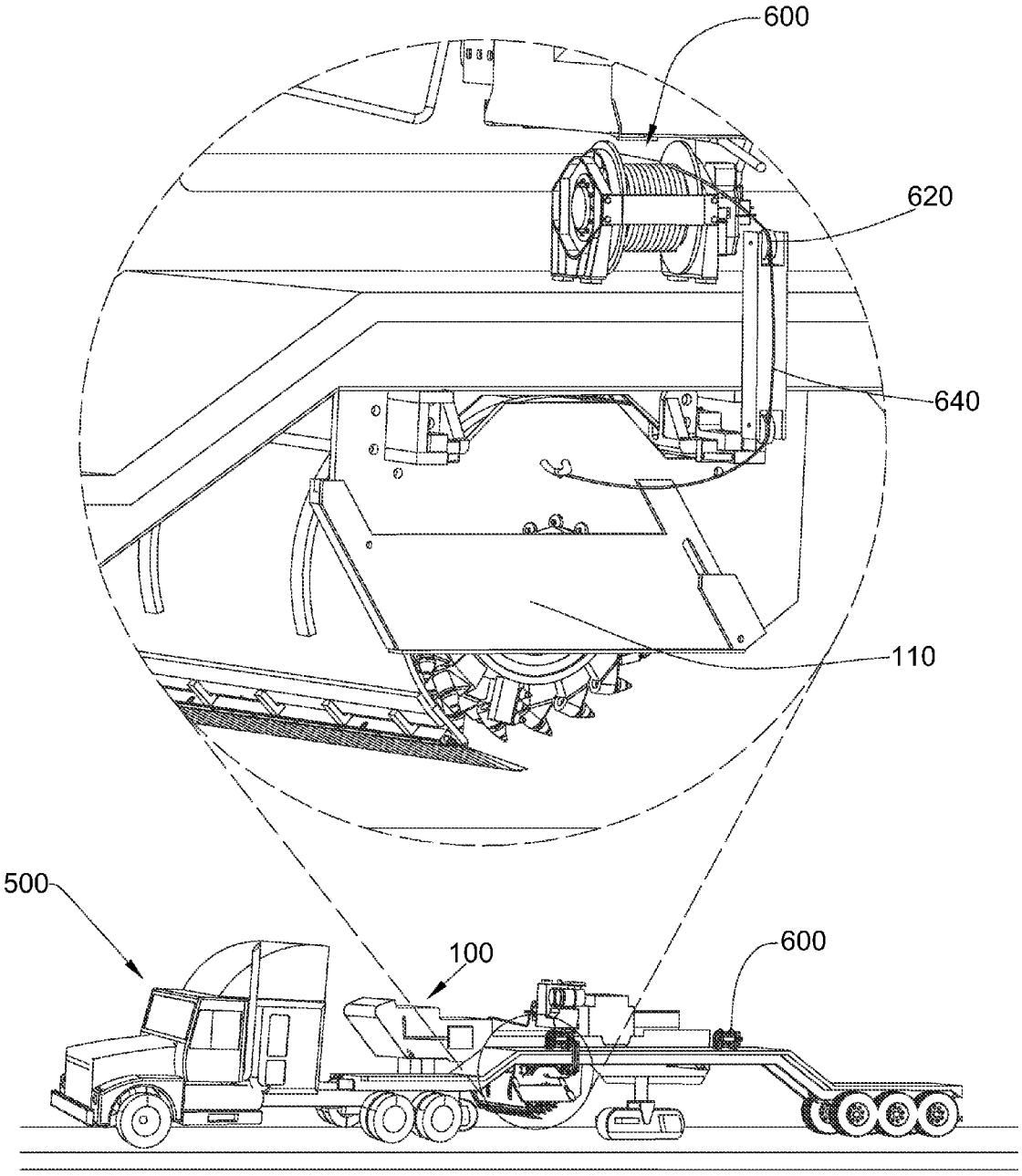
FIG. 6 is a perspective diagram of an embodiment of a milling machine and a semi-truck.

Referring to FIG. 6, the semi-truck 500 may comprise at least one winch assembly 600 configured to pull the milling chamber 110 laterally with respect to the length of the semi-truck 500. The milling chamber 110 may be exchanged between the milling machine 100 and the semi-truck 500 by using the winch assembly 600. The semi-truck 500 may also comprise a pulley 620 configured to guide a cable 640 of the winch assembly 600 when pulling the milling chamber 110. The winch assembly 600 may be in communication with a rotor of a motor. The vehicle may incorporate a plurality of direction change pulleys to move the milling chamber.

Figure 7:
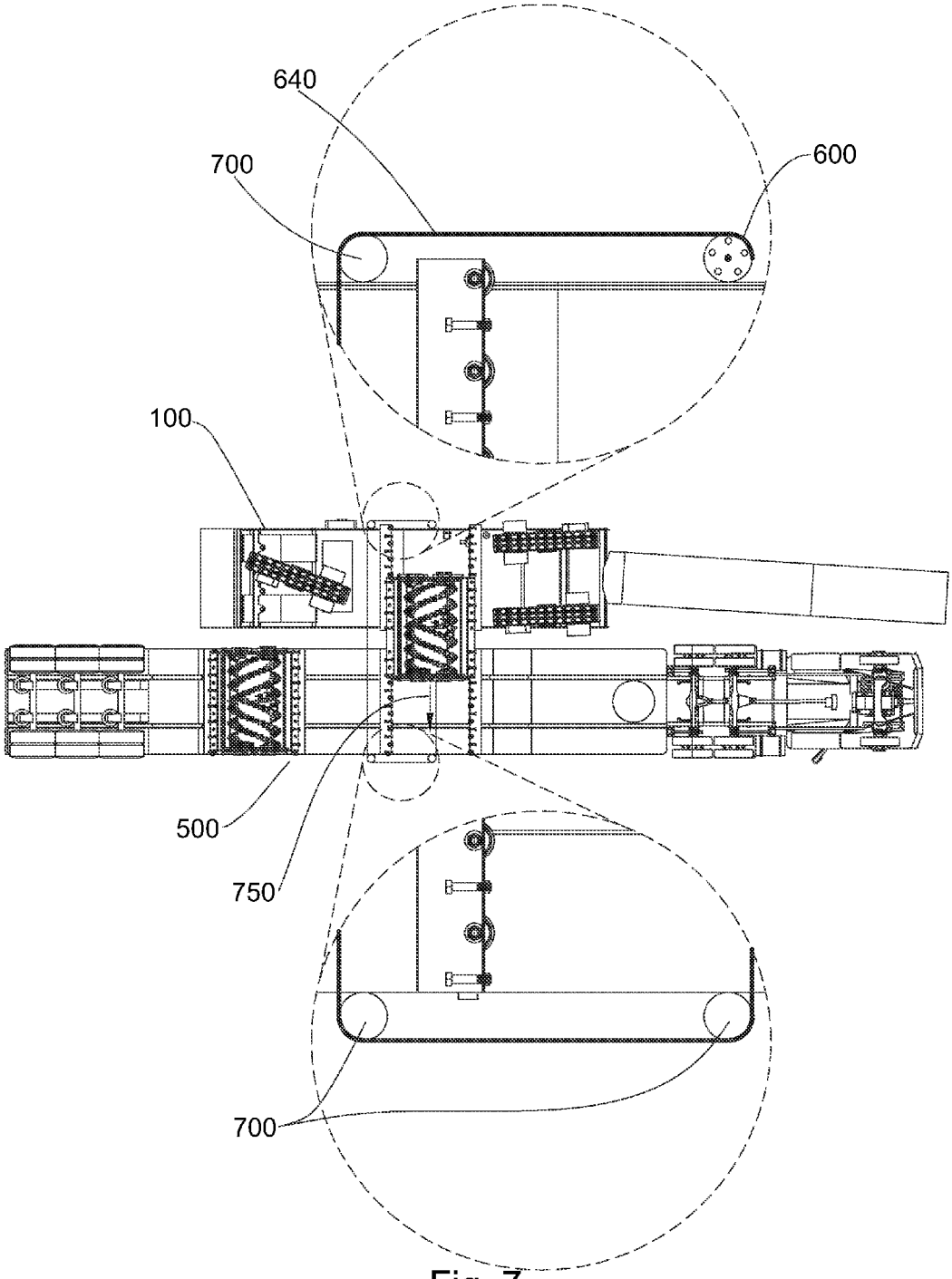
FIG. 7 is an orthogonal diagram of another embodiment of a milling machine and a semi-truck.

FIG. 7 discloses an orthogonal diagram of an embodiment of the milling machine 100 and a semi-truck 500 comprising a plurality of pulleys 700 configured to produce lateral movement of the milling chamber 110. The milling machine 100 may further comprise a winch assembly 600. The pulleys 700 may be disposed on far ends of the milling machine 100 and the semi-truck 500. The cable 640 of the winch assembly 600 passing over the pulleys 700 may be attached to the milling chamber 110 to produce lateral movement. The direction of movement of the milling chamber 110 from the milling machine 100 to the semi-truck 500 is shown by an arrow 750.

Figure 8:
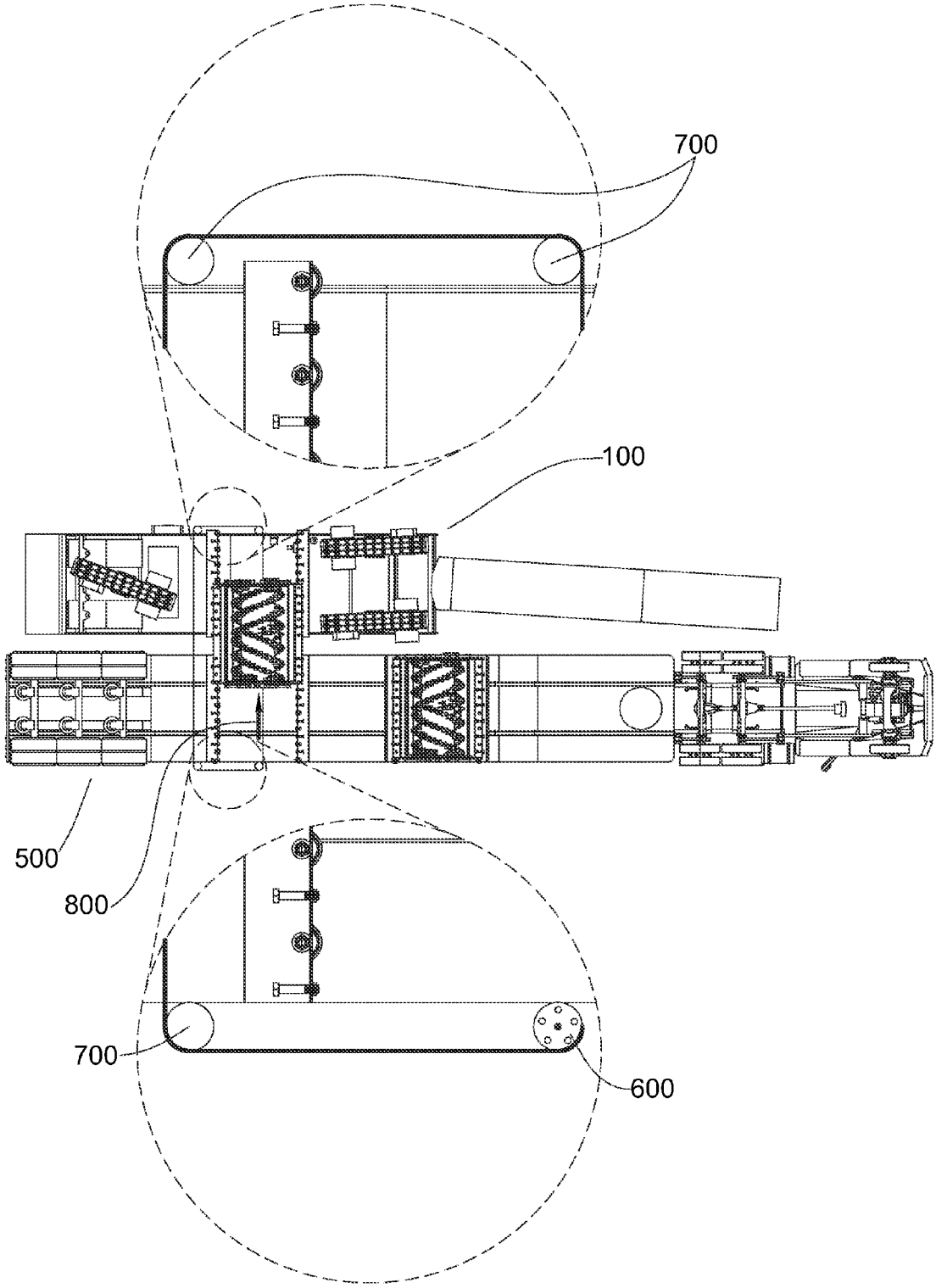
FIG. 8 is an orthogonal diagram of another embodiment of a milling machine and a semi-truck.

Referring to FIG. 8, the semi-truck 500 comprising a serviced rotary drum assembly may be exchanged between the milling machine 100 and the semi-truck 500. The semi-truck 500 may comprise the winch assembly 600 configured to pull the milling chamber 110 away from the semi-truck 500 towards the milling machine 100. The pulleys 700 may help to develop the lateral movement of the milling chamber 110. The direction of movement of the milling chamber 110 is shown by an arrow 800.

In some embodiments, the only milling drum is exchanged, instead of the entire milling chamber. A quick disconnect system may allow the drum to be quickly disengaged from the belts, chains, or other mechanisms that cause the drum to rotate.

In some embodiments, the milling chamber may be exchanged with a stand instead of the underside of a vehicle. A spare milling chamber may be held by the stand while the milling machine is in operation. When replacing the milling chamber is desired, the spare milling chamber may be exchanged with the worn milling chamber. While the spare milling machine is in use, the worn milling chamber may be serviced to replace the spare milling chamber when it needs serviced.

Figure 9:
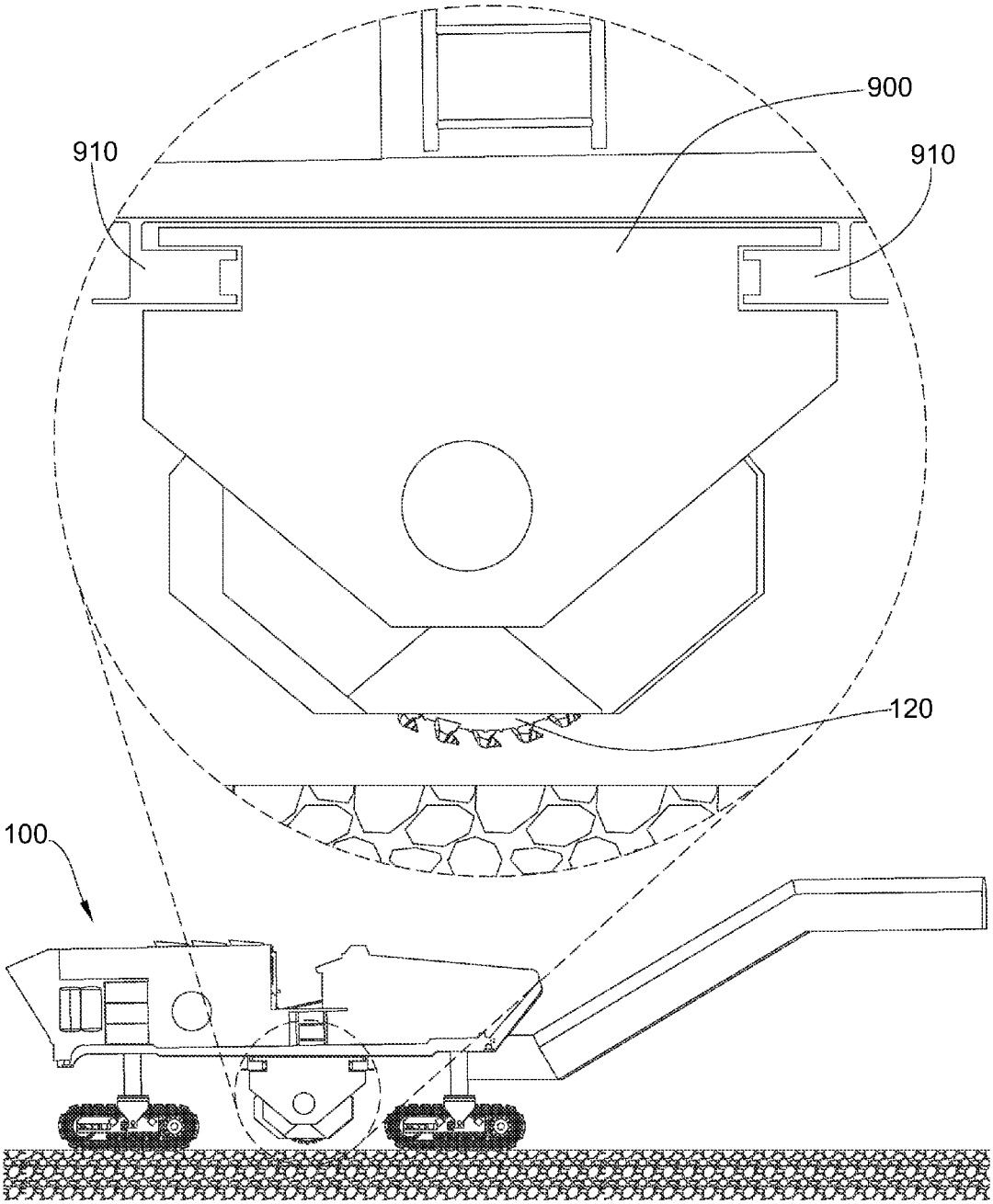
FIG. 9 is an orthogonal diagram of another embodiment of a milling chamber.

FIG. 9 discloses another embodiment of a milling machine 100 comprising structures configured to produce lateral movement of the milling chamber 900. The milling chamber 900 may comprise the rotary drum assembly 120. The milling machine 100 may comprise at least one rail 910 supported by the underside of the milling machine 100. The milling chamber 900 may be configured to slide over the rail 910. The rail 910 may be lubricated. The milling chamber 900 may be temporarily attached to the milling machine 100 with bolts, U-bolt plates, clamps, or combinations thereof. Such an attachment may provide stability to the rotary drum assembly 120 during operation.

Figure 10:
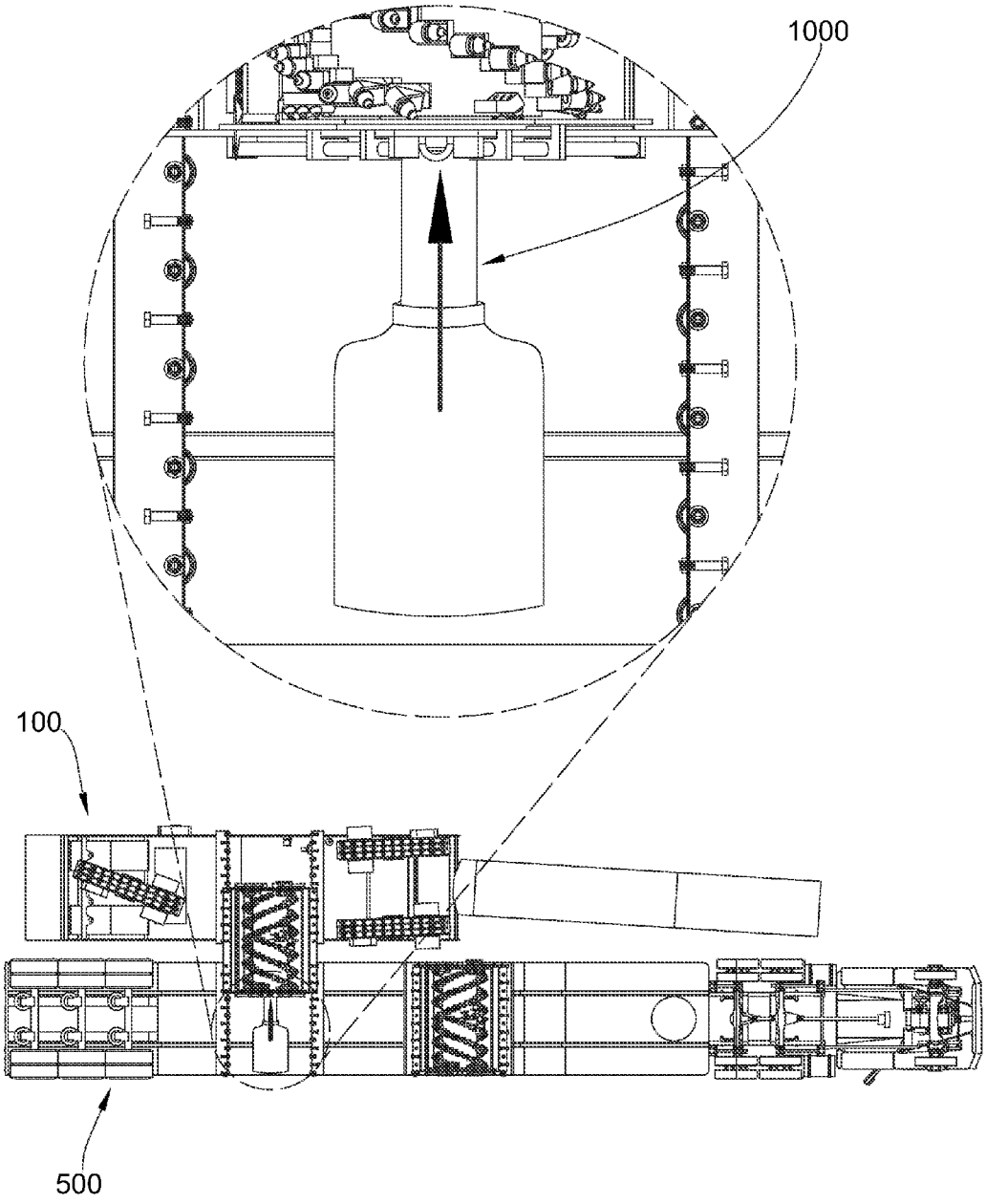
FIG. 10 is an orthogonal diagram of another embodiment of a milling machine and a semi-truck.

Referring to FIG. 10, a hydraulic ram 1000 may be configured to push the milling chamber 110 while exchanging the milling chamber 110 between the milling machine 100 and the semi-truck 500. The hydraulic ram 1000 may comprise a stroke length sufficient to push the milling chamber 110 from the milling machine 100 to the semi-truck 500 or vice-versa. The direction of movement of the hydraulic ram 1000 is shown in the figure. In some embodiments, the hydraulic ram may be a telescoping ram to increase the ram's stroke. The hydraulics may be powered by an air to hydraulic pump using an air compressor already equipped on the vehicle. The hydraulics could also be powered by gas, diesel, and/or electric motors.

In some embodiments the vehicle may be a hook truck that may be configured to move the milling chamber laterally. In other embodiments, a separate hook truck may be configured to assist in moving the milling chamber laterally either under the milling machine or under a transporting vehicle.

Figure 11:
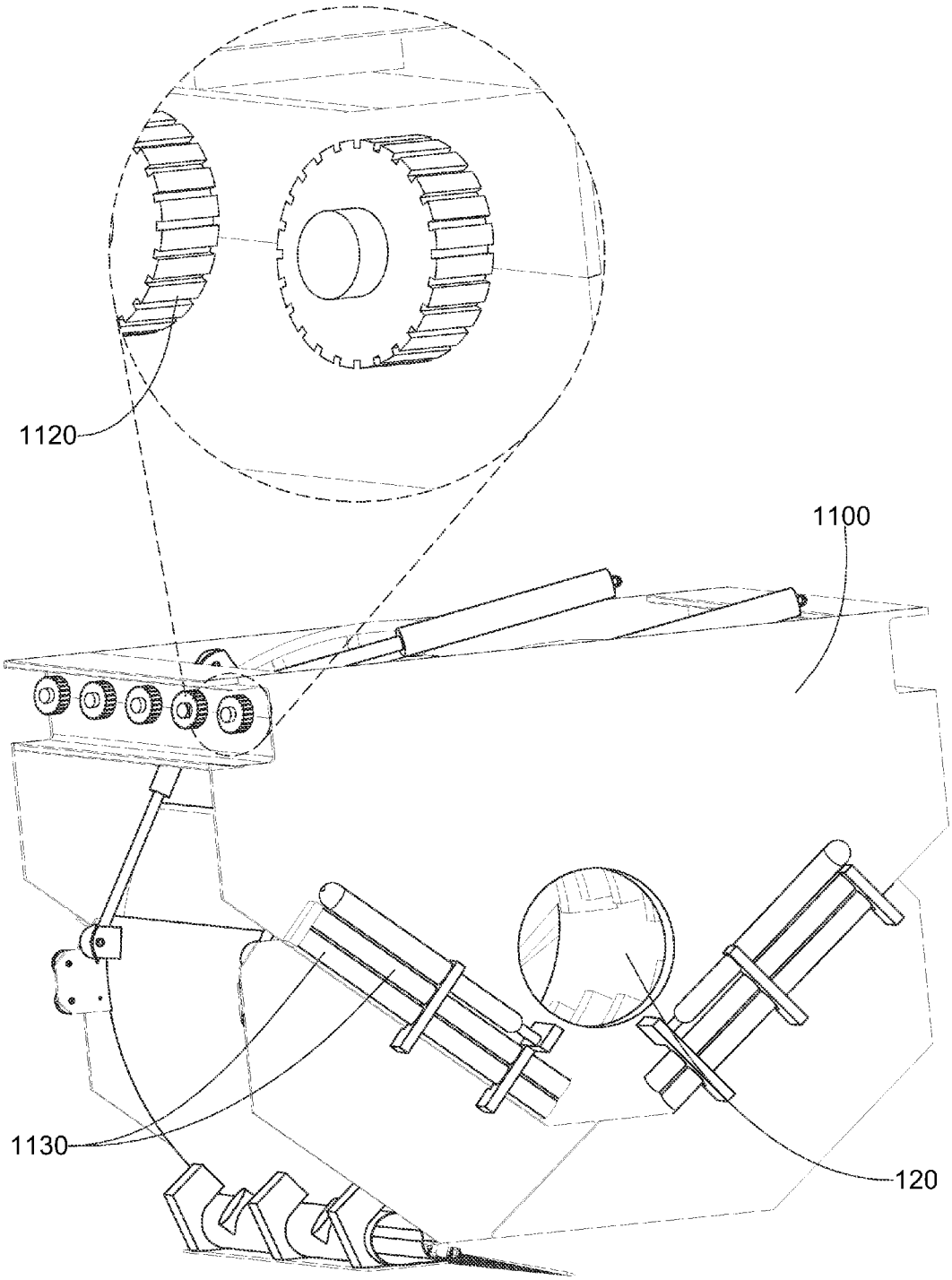
FIG. 11 is a perspective diagram of another embodiment of a milling chamber.
Figure 12A:
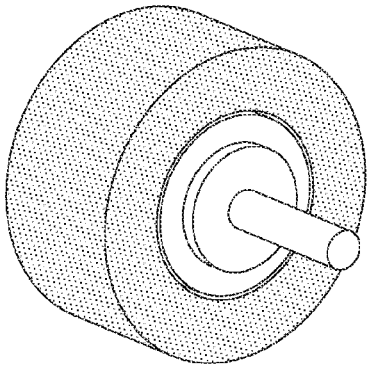
FIG. 12*a* is a perspective diagram of an embodiment of a roller.
Figure 12B:
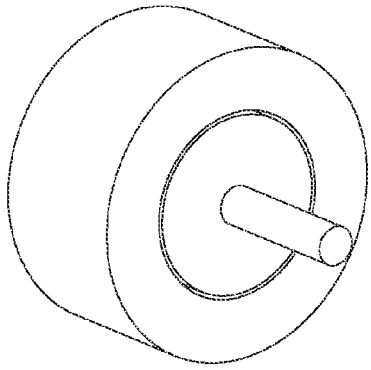
FIG. 12*b* is a perspective diagram of an embodiment of a roller.
Figure 12C:
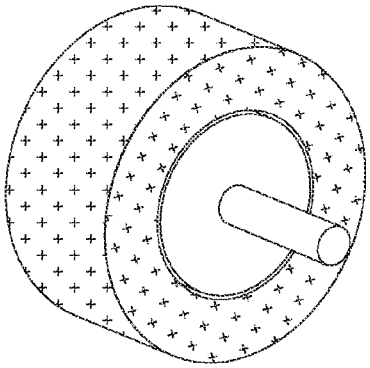
FIG. 12*c* is a perspective diagram of an embodiment of a roller.
Figure 12D:
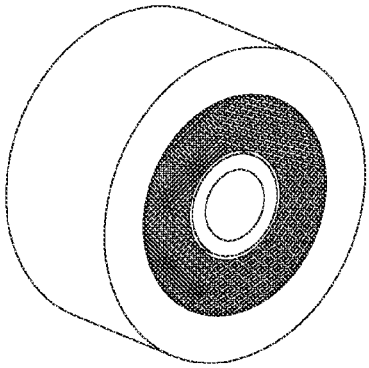
FIG. 12*d* is a perspective diagram of an embodiment of a roller.
Figure 12E:
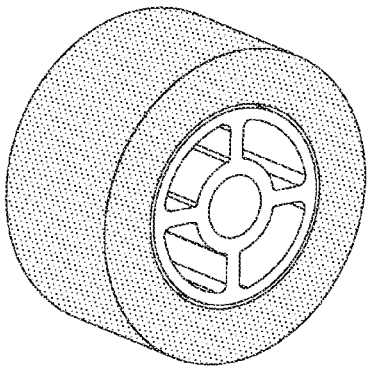
FIG. 12*e* is a perspective diagram of an embodiment of a roller.
Figure 12F:
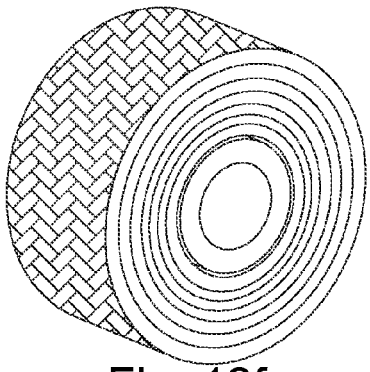
FIG. 12*f* is a perspective diagram of an embodiment of a roller.

FIG. 11 discloses another embodiment of a milling chamber 1100 comprising rollers 1120 on both sides to allow lateral movement of the milling chamber 1100 with respect to a length of a milling machine 100. The milling chamber 1100 may further comprise a hydraulic mechanism comprising hydraulic cylinders 1130 configured to adjust a height of the rotary drum assembly 120. At least one roller 1120 may be connected to a motor. The rollers 1120 may roll over the rails 910 supported by the underside of the milling machine 100.

FIG. 12*a-f* discloses a perspective diagram of embodiments of the rollers 1120. The rollers may comprise rubber 1200, metal 1210, ceramics 1220, composites 1230, or combinations thereof. Rollers 1120 comprising a particular material may provide a specific advantage over roller 1120 comprising other material. For instance, rollers 1120 comprising rubber 1200 may maximize frictional force while rollers 1120 comprising metal 1210 and ceramics 1220 may minimize frictional force. Rollers 1120 comprising composites 1230 may possess high strength and light weight. Rollers 1120 comprising a combination of metal 1210 and rubber 1200 may provide high endurance.

Figure 13:
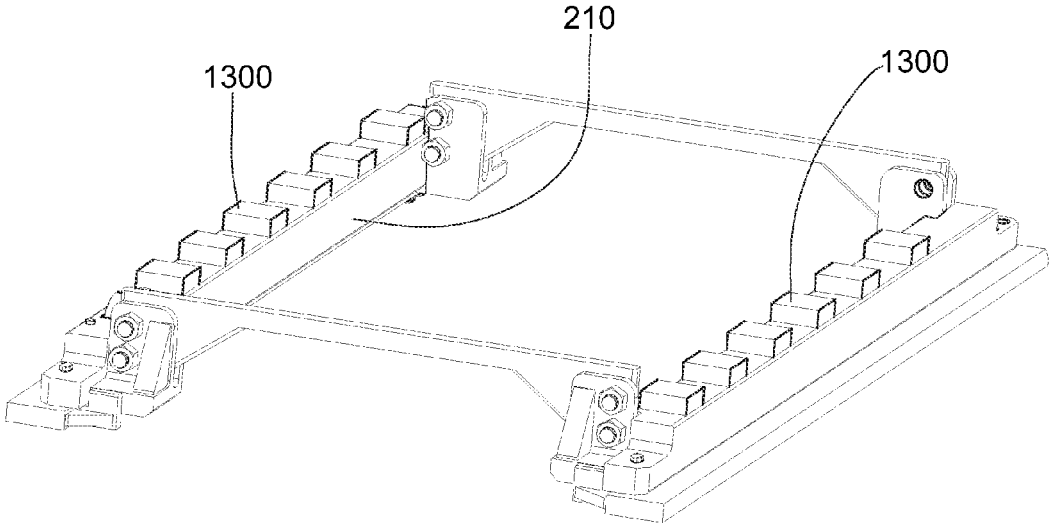
FIG. 13 is a perspective diagram of another embodiment of a track of a milling machine.

FIG. 13 is a perspective diagram of another embodiment of the track 210 comprising a rack 1300. A milling chamber may comprise a pinion such that the combination of the rack 1300 and pinion produces a lateral movement of the milling chamber.

In some embodiments of the invention, a track to accommodate lateral movement of the milling chamber may be placed on the ground and the milling chamber may be rolled between vehicles on this track.

Figure 14A:
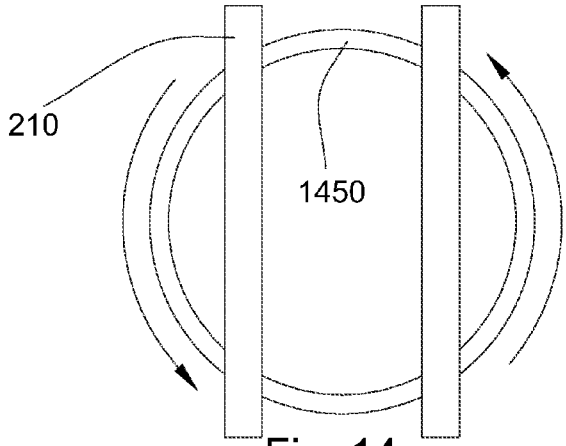
FIG. 14*a*is an orthogonal diagram of an embodiment of an underside of a vehicle.
Figure 14B:
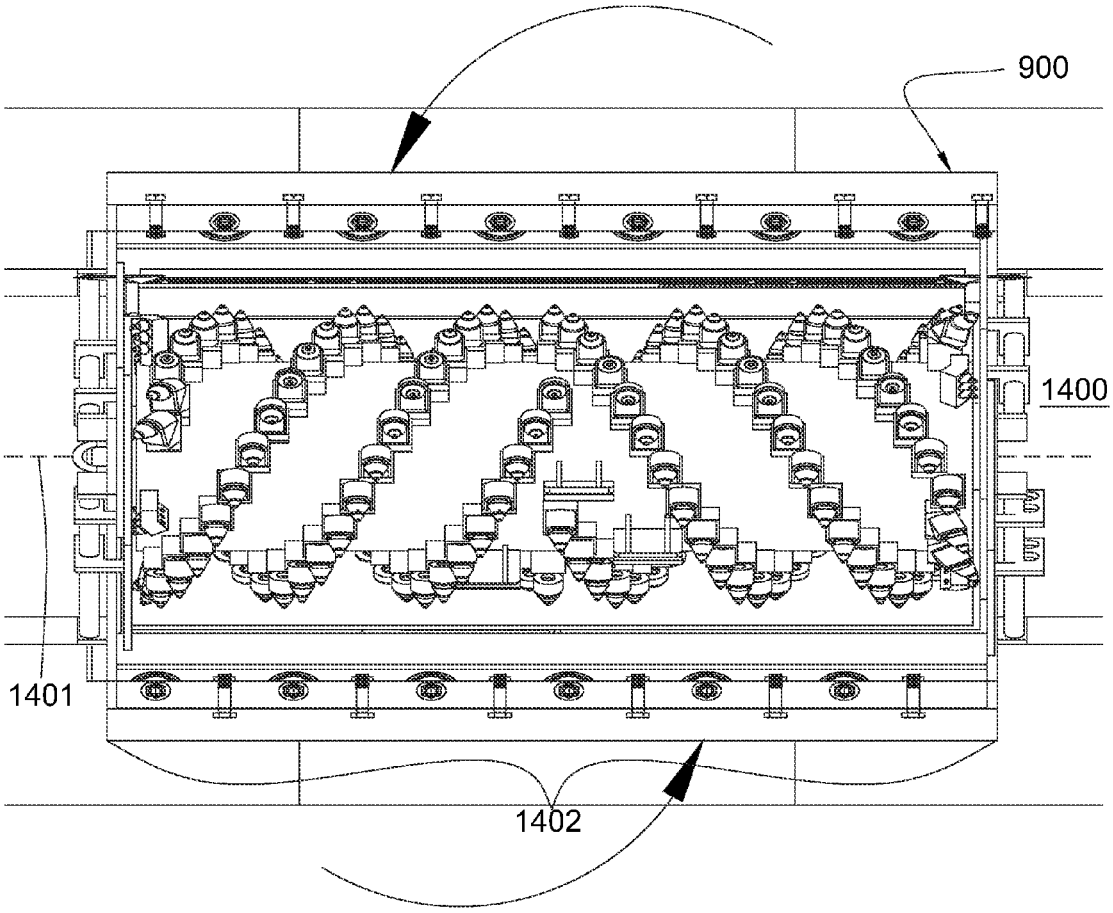
FIG. 14*b* is an orthogonal diagram of an embodiment of an underside of a vehicle.

FIG. 14*a* discloses a circular track 1450 attached to an underside of a vehicle that may rotate the track 210. FIG. 14*b* discloses the milling chamber 900 being rotated by a circular track 1450 of FIG. 14*a*. In some embodiments, the milling chamber may be wider than government laws or rules allow. In such cases, the milling chamber may be rotated such that the width 1402 of the milling chamber is aligned with the length 1401 of the underside. In some embodiments, it may be beneficial to mill with a rotated or partially rotated milling chamber with respect to the length of the vehicle's length; thus, the circular of FIG. 14*a* may be incorporated in a milling machine.

Figure 14C:
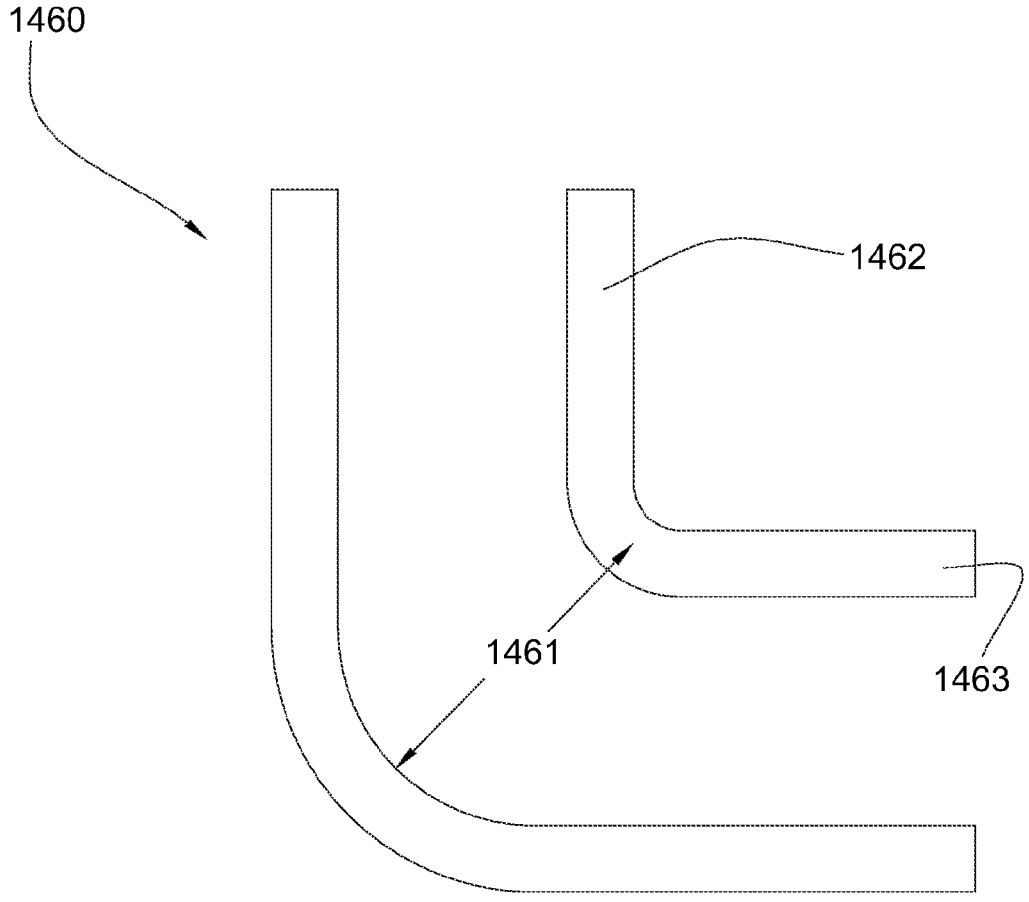
FIG. 14*c* is an orthogonal diagram of an embodiment of an underside of a vehicle.

FIG. 14*c* discloses another embodiment of a curved track 1460. This track 1460 allows the milling chamber to be moved onto the underside of the machine and slide into a rotated position in a single step. A curved joint 1461 joins straight portions 1462, 1463 of the track. However, the claims of the present invention are not limited to specific configuration of curved and straight track portions.

Whereas the present invention has been described in particular relation to the drawings attached hereto, it should be understood that other and further modifications apart from those shown or suggested herein, may be made within the scope and spirit of the present invention.

Figure 15:
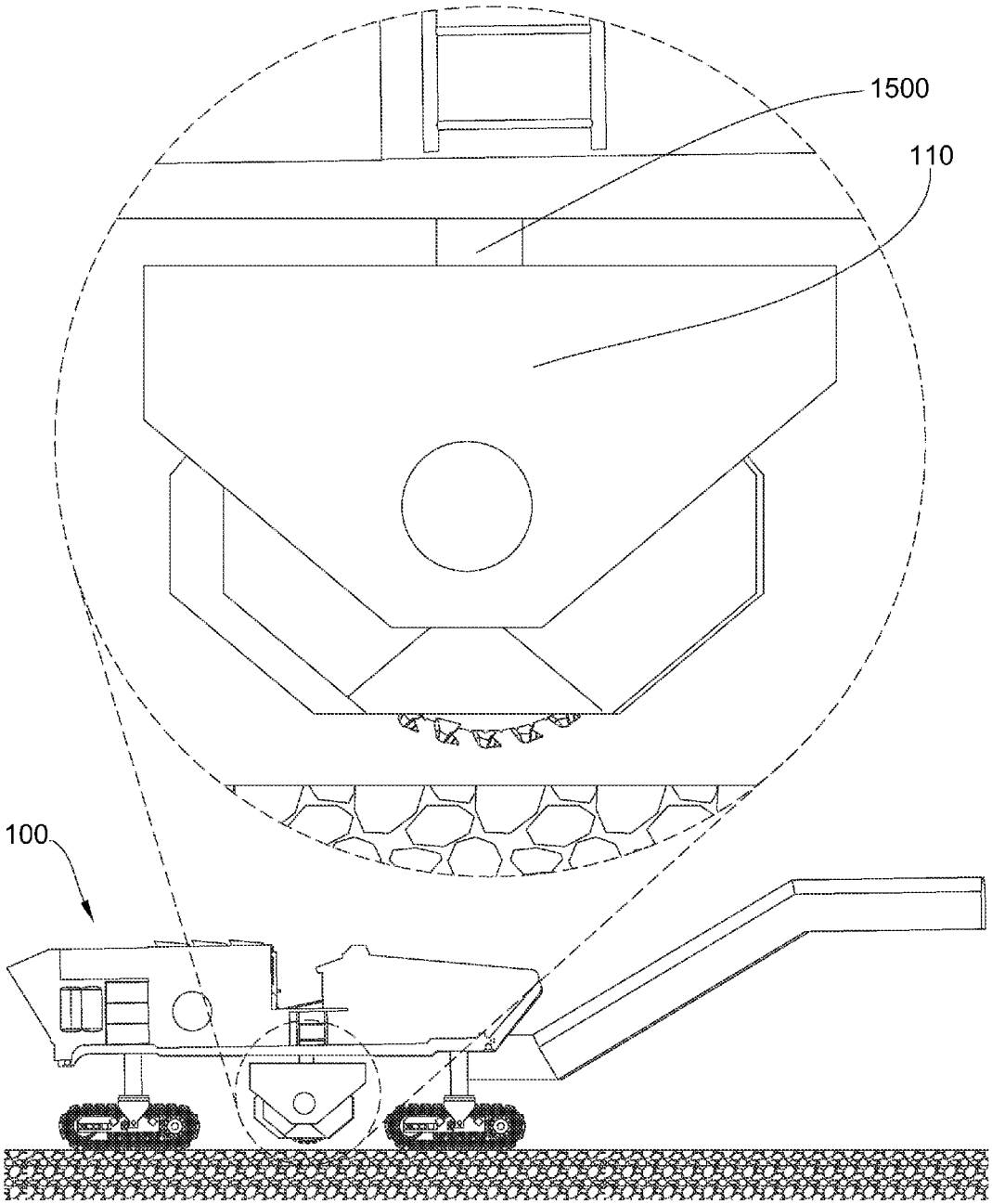
FIG. 15 is an orthogonal diagram of an embodiment of a milling chamber.

FIG. 15 discloses a milling chamber connected to the underside of a vehicle through a mechanism that contains a pivot 1500. The milling chamber may be configured to rotate with respect to the length of the vehicle about the pivot. The vehicle may be a milling machines or other vehicle.

What is claimed is:

1. A system for exchanging a milling chamber, comprising:

a vehicle comprising a milling chamber supported by an underside of the vehicle;

the underside comprising a track that interfaces with a guide of the milling chamber;

wherein the track and guide are configured to accommodate lateral movement of the milling chamber with respect to a length of the vehicle; and wherein the guide is configured to hang off the track.

2. The system of claim 1, wherein the vehicle is a milling machine.

3. The system of claim 1, wherein the milling chamber comprises a rotary drum assembly.

4. The system of claim 1, wherein the track comprises at least one roller configured to move the milling chamber.

5. The system of claim 4, wherein the roller is in mechanical communication with a rotor of a motor.

6. The system of claim 1, wherein the milling chamber comprises a moldboard aligned concentrically with a rotary drum assembly.

7. The system of claim 1, wherein the milling chamber comprises a water jet manifold attached to an end of the moldboard.

8. The system of claim 1, wherein the guide comprises a structure configured to stop a lateral movement of the milling chamber as the milling chamber approaches an end of the guide.

9. The system of claim 1, wherein the vehicle comprises a winch assembly configured to pull the milling chamber laterally.

10. The system of claim 9, wherein a pulley is configured to guide a cable of the winch assembly when pulling the milling chamber.

11. The system of claim 1, wherein the underside of the vehicle is located on a trailer.

12. The system of claim 1, wherein the vehicle is a truck.

13. The system of claim 1, wherein the system comprises a hydraulic ram configured to push the milling chamber.

14. The system of claim 1, wherein the track and guide interface through a rack and pinion arrangement.

15. The system of claim 1, wherein a second track is linked to a first track by a cross arm attached to the milling machine.

16. The system of claim 1, wherein the underside comprises a mechanism configured to distribute a weight of the milling chamber off of the guide.

17. The system of claim 1, wherein the milling chamber is configured to rotate such that a width of the milling chamber is aligned with the length of the vehicle.

18. A method of replacing a rotary drum assembly on a milling machine, comprising the steps of:

providing a milling machine comprising a rotary drum assembly supported by an underside of the machine;

providing a separate vehicle configured to carry a plurality of rotary drum assemblies;

aligning the milling machine with the separate vehicle; and exchanging at least one rotary drum assembly between the milling machine and the separate vehicle with a sliding mechanism.

19. A system for exchanging a rotary drum assembly, comprising:

a vehicle comprising a rotary drum assembly supported by an underside of the vehicle;

the underside comprising a track that interfaces with a guide of the rotary drum;

wherein the track and guide are configured to accommodate lateral movement of the rotary drum assembly with respect to a length of the vehicle; and wherein the guide is configured to hang off the track.

* * * * *